US005142460A

United States Patent [19]

McAtee

[11] Patent Number: 5,142,460

[45] Date of Patent: Aug. 25, 1992

[54] ENERGY SAVING LIGHTING SHOWROOM DISPLAY UNIT

[76] Inventor: Jack McAtee, P.O. Box 214228, Sacramento, Calif. 95821

[21] Appl. No.: 618,079

[22] Filed: Nov. 26, 1990

[51] Int. Cl.[5] ..... F21V 21/02

[52] U.S. Cl. ..... 362/249; 362/251; 362/394; 362/150; 200/574

[58] Field of Search ..... 362/249, 251, 394; 200/341, 573, 574; 40/463, 464

[56] References Cited

U.S. PATENT DOCUMENTS

| | | | |
|---|---|---|---|
| Re. 28,249 | 11/1974 | Estrem | 200/574 |
| 3,612,800 | 10/1971 | Slopa | 200/574 |
| 4,297,556 | 10/1981 | Taylor | 200/341 |
| 4,775,921 | 10/1988 | Foley | 362/147 |

FOREIGN PATENT DOCUMENTS

| | | | |
|---|---|---|---|
| 2201926 | 6/1978 | Fed. Rep. of Germany | 200/574 |
| 1381275 | 1/1975 | United Kingdom | 200/574 |

*Primary Examiner*—Ira S. Lazarus
*Assistant Examiner*—Y. Quach
*Attorney, Agent, or Firm*—Mark C. Jacobs

[57] ABSTRACT

A display unit for customers to inspect lighting fixtures being offered for sale, wherein the customer can easily actuate the lights present in the display for a finite period of time. A push-button control system is featured wherein the button activates a microswitch, which turns on a motorized timer circuit having a cam associated therewith. The lights on the display are electrically actuated when the microswitch is activated. The timer cam rotates until such time elapses as is required for the cam to recontact the microswitch. When contact is made again, the lights are extinguished, and awaiting the next activation.

8 Claims, 4 Drawing Sheets

ENERGY SAVING LIGHTING SHOWROOM DISPLAY UNIT

BACKGROUND OF THE INVENTION

Lighting for purchase generally comprises two styles of lights, wall mounted and ceiling mounted. To better simulate room environments, and to reduce the number of lights being inspected by a customer at any one time, showrooms use lighting displays to showcase specific fixtures. These lighting displays feature both wall and ceiling mounted fixtures.

Showroom lighting displays today, generally operate upon the throwing of a master switch to turn on all of the lights of one or all of the display units. In the alternative, pull chains are gerrymandered to switches that operate nondisplay ceiling mounted lights on a one by one basis. This latter requires two steps by the customer to pull the chain to turn a specific light on and another to turn it off. Often however, the customer neglects to carry out step two.

While timers and timing circuits are well known in lighting circles, no one has created an energy efficient lighting display timer for use in lighting showrooms, that is one that can support 20 amp service.

There is a need therefore for an energy saving control system for lighting displays that is easy to operate.

It is an object therefore of this invention to provide a lighting display that is easily actuated by the potential customer.

It is another object to provide a lighting display wherein the lighting which has been actuated by a customer, turns itself off.

Yet another object is to provide a lighting display system capable of 20 amp operation.

Still another object is to provide a control system for lighting displays that permits several display units to be controlled by one actuator.

This and other objects of the invention will in part be obvious and will in part appear hereinafter.

The invention accordingly comprises the product possessing the features, properties and the relation of components which are exemplified in the following detailed disclosure and the scope of the application of which will be indicated in the claims.

For a fuller understanding of the nature and objects of the invention reference should be made to the following detailed description taken in conjunction with the accompanying drawings.

SUMMARY OF THE INVENTION

A retail store display unit for customers to inspect lighting fixtures in operative condition, for a finite period of time. A push-button control system is featured wherein the button activates a microswitch, which turns on a motorized timer circuit having a cam associated therewith. The lights on the display are electrically actuated when the microswitch is activated. The timer cam rotates until a preselected time period elapses, equal to the time required for the cam to rotate and recontact the microswitch. When contact is made again, the lights are extinguished, until the next activation.

DESCRIPTION OF THE PREFERRED EMBODIMENT

Figure 1:
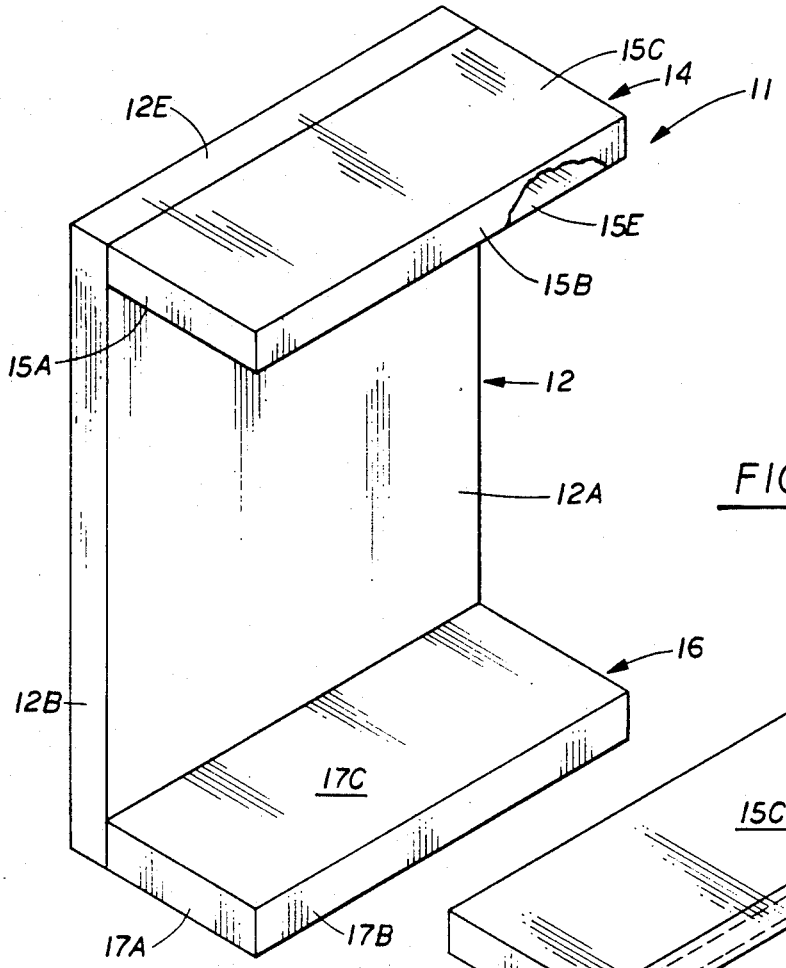
FIG. 1 is a front perspective view of the superstructure of the lighting display unit of this invention.
Figure 2:
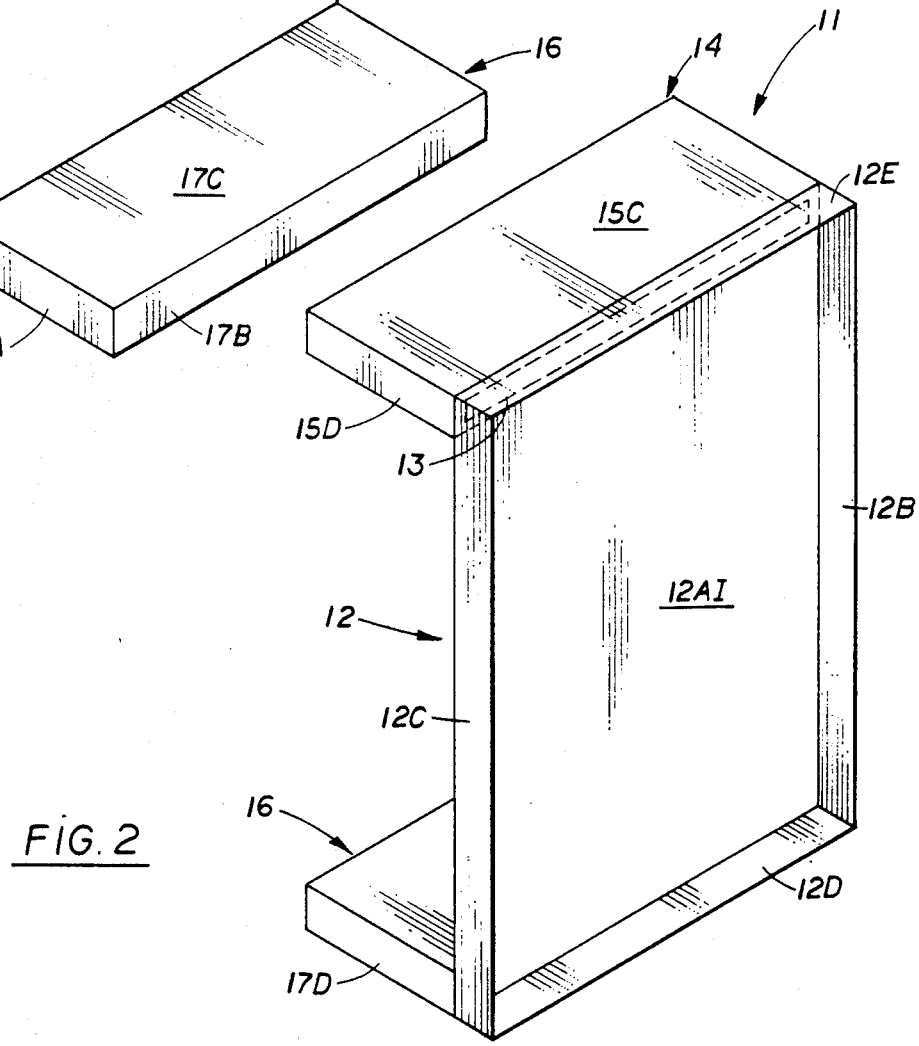
FIG. 2 is rear perspective view of this superstructure.

In FIG. 1, the superstructure 11 portion of this total invention is seen. It features a main body portion 12 having a front wall 12A, spaced side walls 12B and 12C normal to said front wall, and a spaced top and bottom walls 12E and 12D respectively, disposed normal to both the front wall and the two side walls, thus defining a box with a rear opening. In FIG. 2, the interior or rear surface of the front wall 12A is designated 12AI.

A top front projection section 14 is disposed onto the main body portion as is seen in FIGS. 1 and 2. It includes spaced side walls, 15A and 15D, a front wall 15B and a top wall 15C and a spaced therefrom bottom wall 15E, this last being visible in the cutaway of the wall 15B in FIG. 1. There is no rear wall to this projection and access thereto is via the elongated slot 13 in the front wall 12 of the main body portion.

A base or balancing portion 16 is also seen in the figures. This base 16 serves to provide stability such that the superstructure 11 can be self-supporting. Base 16 includes a front vertical wall 17B, a pair of spaced sidewalls 17A, 17D which are disposed normal to the front wall. A top wall 17C connects the two side walls and is also connected to the front wall along the upper edge thereof. An optional bottom wall (not seen) may be employed, as may a rear wall, but neither is required for stability.

Figure 3:
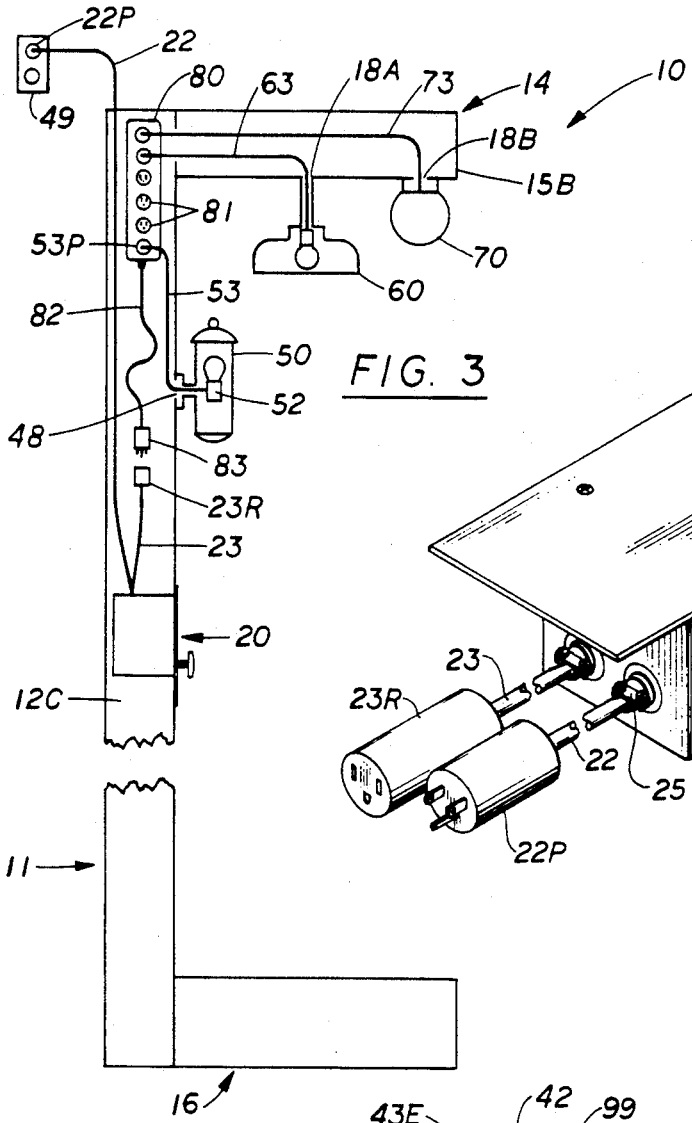
FIG. 3 is a sectional view of the apparatus of this invention.

The discussion now centers upon FIG. 3, which is a sectional view of the superstructure, this view illustrates the entire invention 10. Thus the top projection 14 is seen to be extending forwardly from and normal to the main body portion 12 of the superstructure 11. The base 16 is also shown at the lower end of the main body, also extending forwardly in the same direction as the top projection.

Light control system 20 is seen mounted on the front wall 12A of main body portion 12. The system 20 will be discussed with more particularity infra. Emanating from the control system 20 is a first line cord 22 having a male plug on the end of it. This plug 22P is electrically connected to a 120 V AC outlet, 49. A second line 23 also emanates from system 20. This line terminates in a female receptacle 23R.

A conventional multioutlet power strip 80 is conventionally mounted as on the wall 12C by any suitable means. A power cord 82 electrically connected to all of the parallel-wired outlets 81 of the strip 80. A male plug 83 on the end of power line 82 emanating from the strip is electrically connected to receptacle 23R. See FIG. 3.

A typical wall mount outside light fixture 50 is conventionally mounted to front wall 12A of the main body portion by screws, etcetera not seen. Bulb receptacle 52 is in electrical communication with power strip 80 via line 53 which terminates in plug 53P. Line 53 passes through bore 48 in wall 12A in order to reach the power strip.

Also seen in FIG. 3 are ceiling mount lights 60 and 70. These are also conventionally mounted, but to bottom wall 15E of the top projection 14. The plug terminated wiring 63, 73 of these two fixtures passes through holes 18A & 18B, respectively in bottom wall 15E to reach the power strip 80.

Figure 4:
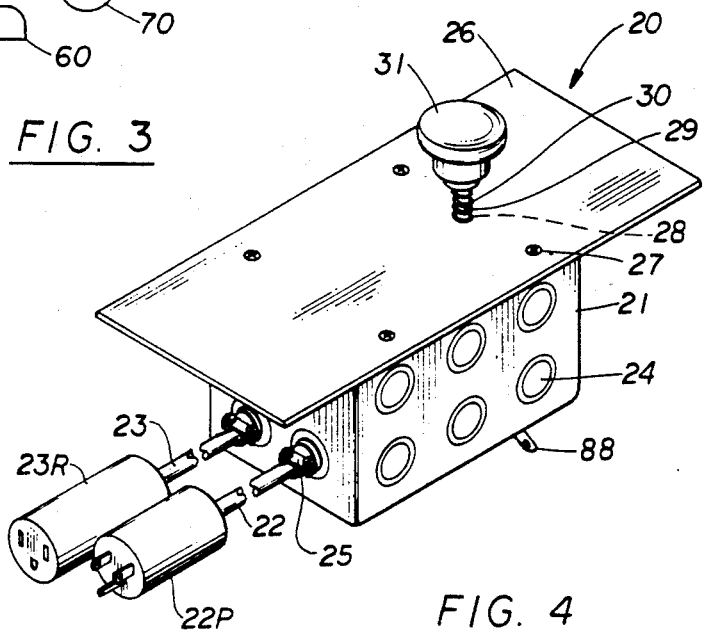
FIG. 4 is a perspective view of the controller box of this invention.
Figure 5:
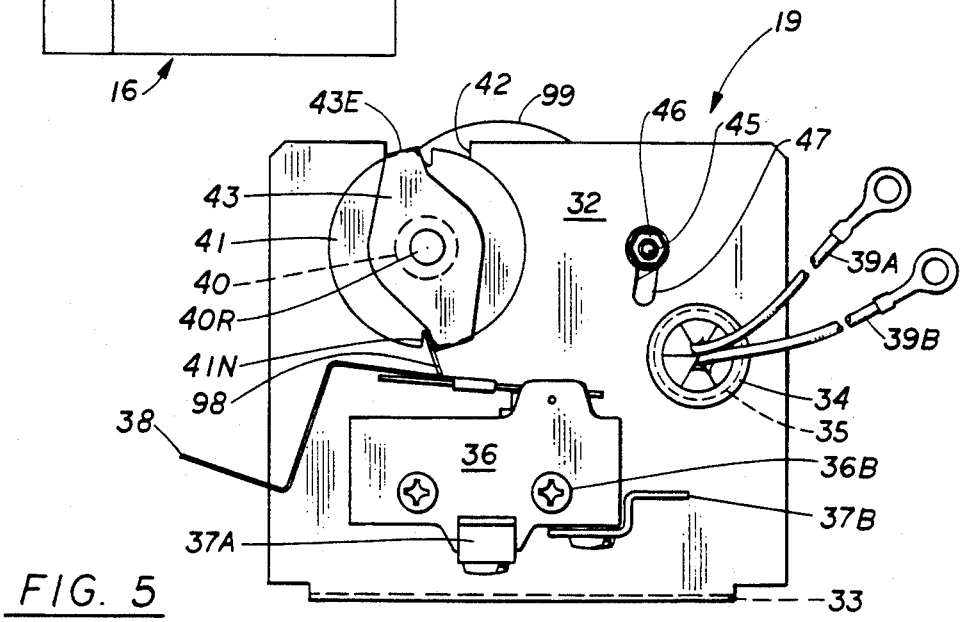
FIG. 5 is a front view of the timer unit portion of this invention.
Figure 6:
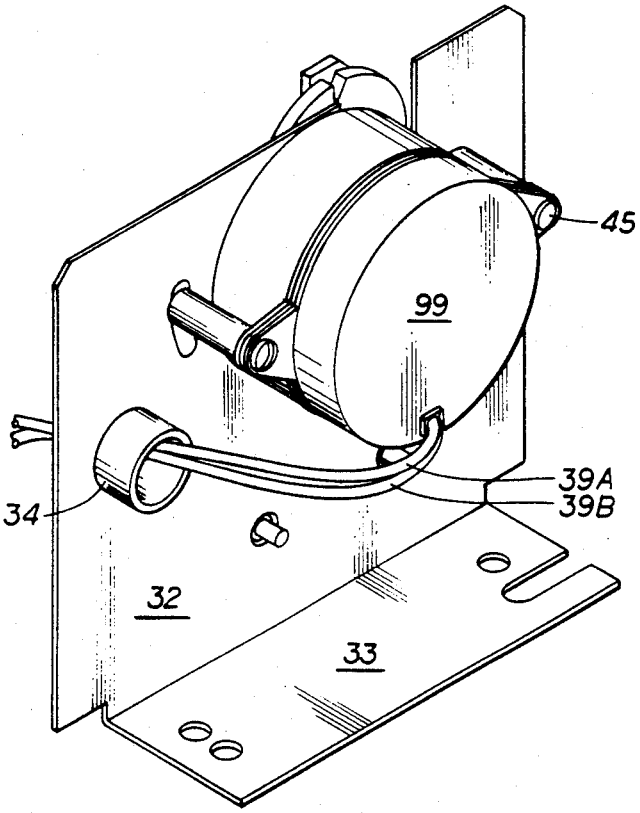
FIG. 6 is a rear view of the timer unit portion of this invention.

The discussion now turns to the details of the light control system 20 as seen in FIGS. 4, 5, and 6. System 20 comprises an open top NEMA 1R multigang box 21 with a plurality of knockouts 24 on the walls thereof. As is seen, two such knockouts 24 have been removed at one end, and replaced by cable retainers 25. These retainers 25 retain lines 22, 23. Top plate 26 is secured to the box by conventional electrical screws 27 threadedly engaged through suitable bores, not seen in said plate to aligned threaded bores 100 in the box 21 per FIG. 7.

Projecting through a suitable bore 28 is a shaft 29 having a return coil spring 30 disposed thereon. A pushbutton knob 31 is suitably mounted on the shaft. A limiter, not seen, to retain the plunger within the bore 28, is employed on the underside of the top plate 26. Such a limiter may take the form of a cotter pin inserted in a suitable aperture in shaft 29; or in the form of a clip mounted in a groove in shaft 29. Both methods are deemed conventional in the art. A suitable actuator for this invention is made by Niagara of Erie, PA., and bears model number 395-2. A grounding lug 88 is shown projecting through the bottom wall of the box 21.

Reference is made now to FIG. 5 wherein sub-assembly 19 comprising a mounting plate 32 with various components thereon is seen with a base plate 33, the latter being best seen in FIG. 6, secured along the lower edge thereof and directed outwardly at about 90 degrees. Obviously these two plates can be made as an integral structure. Disposed in a suitable bore 35 is a star wire retainer 34. Two leads 39A, 39B having spaced connectors thereon emanate from motor 99 (per FIG. 6), and one of said leads is connected to one of the two terminal posts 37A, 37B of the microswitch 36. More on the microswitch and the wiring thereof is to be set forth infra.

A recess slot 42 along the upper edge of mounting plate 32 receives motor 99's shaft 40, shown in dashed line in FIG. 5, with the reduced diameter section thereof being designated 40R also being seen. Disposed on said shaft abutting the main or wider diameter of shaft 40 is disc 41. This disc includes at least one timing notch 41N. The number of notches 41N is related to the speed of the motor and the operational interval desired. Also disposed on the shaft is 40 is a double ended cam 43 having two ends 43E.

Disposed on the mount bracket 32 spaced from both said disc and from the star retainer 34 is a small elongated slot 47 through which passes motor mount bolt 45 which is retained by a nut and lock washer 46 which in turn may be held rigid by a dab of adhesive. This slot is intended for cam height adjustment.

Microswitch 36 is secured to the mount plate 32 by suitable screws or bolts 36B which pass into threaded engagement with suitably sized apertures in the plate 32. The microswitch 36, which is of the normally open variety, has in addition to the terminal posts 37A, 37B referred to previously, a pivotally mounted actuator 38, and an upstanding prong 98 disposed on said actuator at a location where it can be impacted by the cam 43.

On the reverse side of the mount plate 32 is seen the motor 99 secured by motor mount bolts 45—see FIG. 6.

A quite suitable assembly such as shown in FIGS. 5 and 6 for utilization in the construction of this invention may be obtained from the Universal Manufacturing Co. located in Tennessee.

WIRING AND OPERATION AND ASSEMBLY

Figure 7:
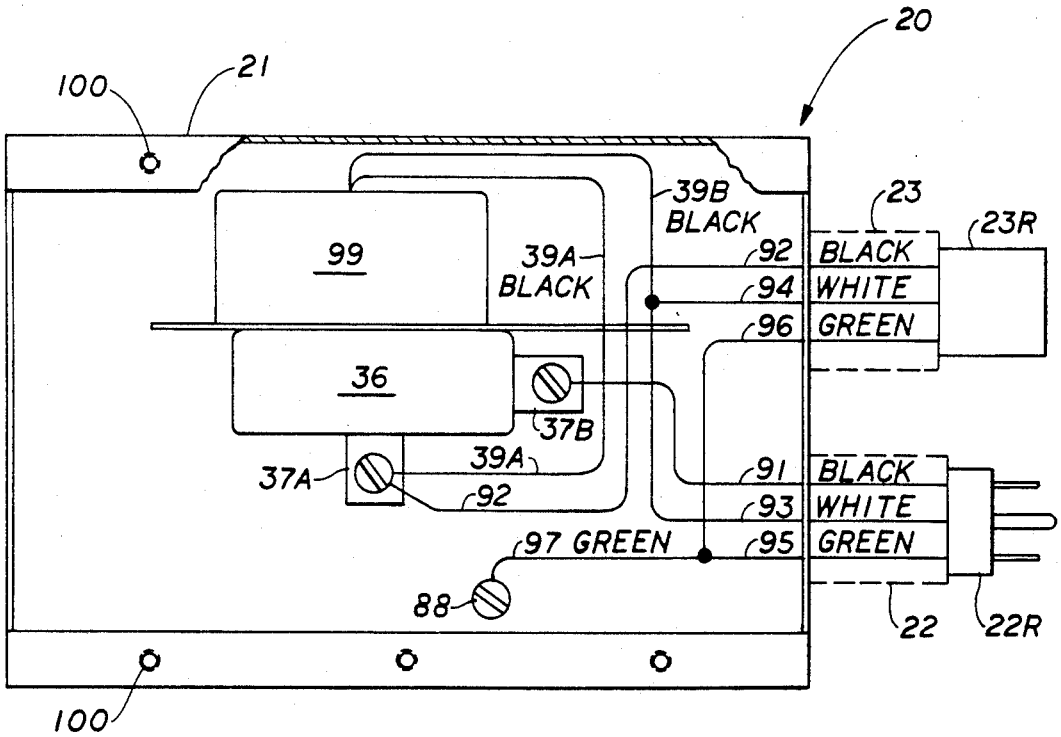
FIG. 7 is a diagrammatic view of the wiring of the control system of this invention.

FIG. 7 is a diagrammatic view of the interior of box 21 showing the wiring of the control system 20, and reference should be had to it and then to FIG. 1. The drive shaft 40, the disk and the cam have been removed as have the two cable retainers 25, to prevent clutter of the drawing.

Power comes to the system 20 from input line 22, a three wire line having for example, black, white and green wires. The black wire 91 from input line 22 is connected to terminal 37B of the microswitch 36. Power goes through the microswitch to the motor via black wire 39A from terminal 37A of the microswitch. Power passing through the microswitch also exists at terminal 37A via wire 92 to the outlet line 23.

The two white wires 93, 94 from the input and output lines respectively are electrically connected to wire 39B, the second wire of the motor, 99. The two green wires 95, 96, one from each cable, are connected to green ground wire 97 which is connected at its opposite end to ground lug 88.

Thus when the microswitch is actuated by impact of the pushbutton shaft 29 upon the actuator 38 current passes through the switch 36 to the motor 99 which causes the shaft 40 of the motor 99 to turn and the disc and cam to rotate. (See FIG. 5) During this period of rotation, power is free to pass from the second terminal 37B of the switch out through line 23 to line 82 of power strip 80 (see FIG. 3). Since the various lights of the display unit namely 50, 60, and 70 are all plugged in to the power strip 80, they become lit during the period of rotation of the disc and cam.

As the cam rotates from an "at rest" position in contact with the prong 98, after initial actuation of the switch, the cam continues its rotation until one of the two ends 43E impacts the prong 98. This causes the prong which is attached to the actuator to move in a downwardly position, simulating the movement of impact by the shaft 29 of the control button or knob 31 on the actuator, thus turning the switch off. The prong comes to rest in notch 41n of the disc, until the next actuation cycle.

Briefly, to repeat the cycle, pushing of the button, causes shaft to impact actuator to turn on microswitch. Power flows through switch and out the control system to the power strip, allowing the lighting fixtures connected thereto to be lit. Simultaneously the motor is actuated by the microswitch, and the shaft of the motor with the disc and cam thereon rotate until the cam impacts the prong. The prong then moves downwardly causing the actuator to turn off the microswitch as the prong comes to rest in the notch of the cam.

In the preferred embodiment of this invention, the motor is set to rotate 180 degrees in 30 seconds, such that one end of the cam impacts the prong after a 30 second period to turn off the power.

It is further to be seen, that the preferred embodiment of the controller aspect of this invention is shown in the exploded diagram. This view illustrates not only the main components which have been described previously, but also the tiny hardware pieces that help complete a commercial product.

Figure 8:
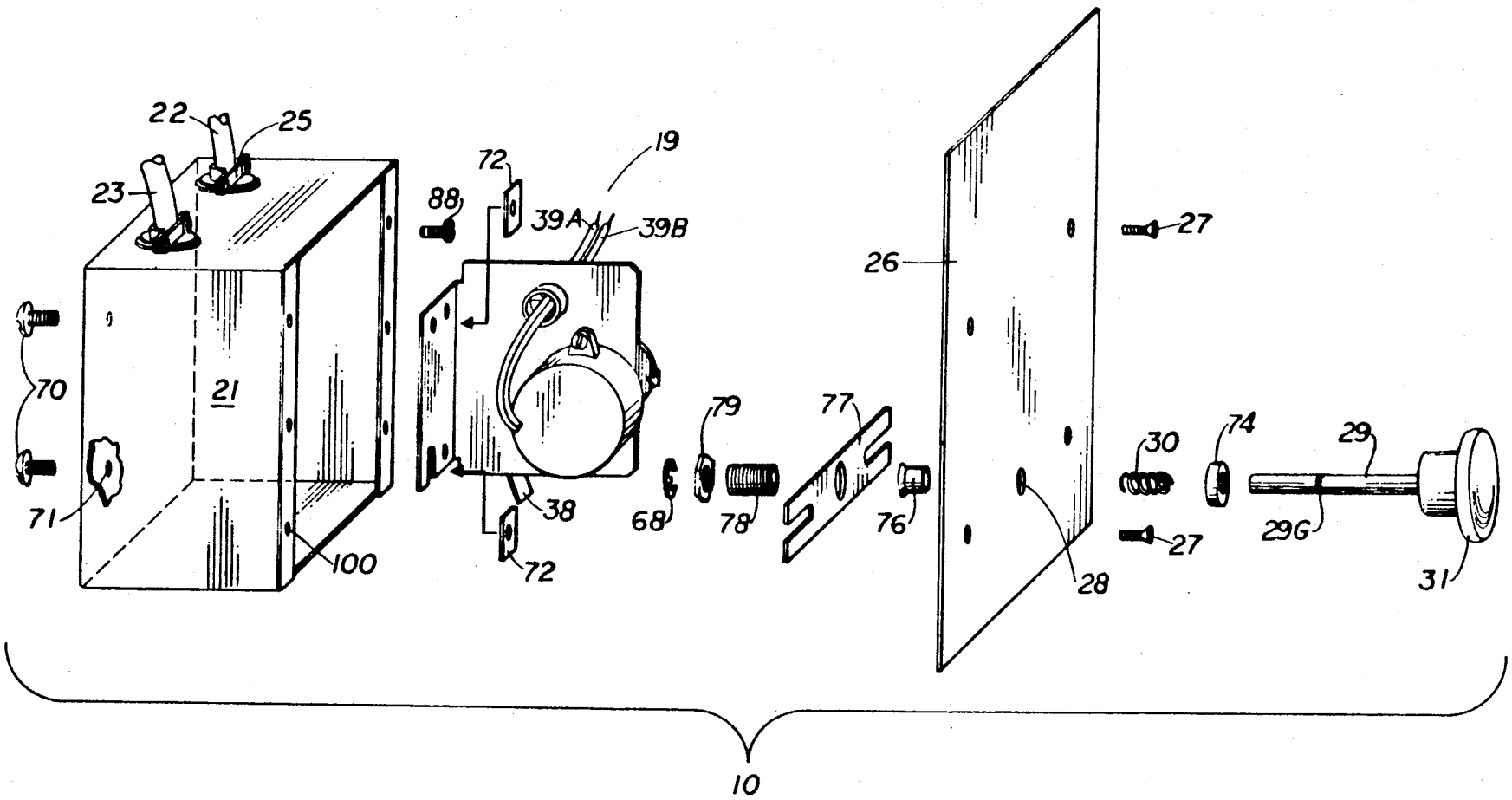
FIG. 8 is an exploded view of the parts and components that form a preferred version of the controller box of this invention.

Turning now to FIG. 8, one sees commencing at the left side thereof, a typical three-gang box 21 housing from which are emanating lines 22, 23. A pair of mount screws 70 have their shafts pass through bores 71 on the rear side of housing 21 for threading into subassembly 19's threaded tabs 72. (Subassembly 19 has been previously discussed.) An optional grounding screw 73 is often conventionally found in housings such as 21.

The top or cover plate, 26, such as a Wiremold Series 6000 unit is secured by screws 27 into holes 100 of the housing 21, as aforementioned. As is seen the knob or control button 31 is suitably mounted on the first end of the shaft 29, which shaft has a retaining ring groove 29G thereon. Also disposed on said shaft 29 on the exterior side of the cover plate 26 are a spring washer 74, and a coil spring 30. A bushing 76 is disposed in bore 28 from the interior side of the cover plate 26 and is of an interior diameter to permit passage of shaft 29 therethrough. Also disposed on the shaft, but on the interior side of the cover plate 26 are a flat bracket 77, an interior threaded nipple 78 which is threadedly engaged to the shaft interior threads, a nut 79 holding the nipple in place and an E-ring, 68 inserted in groove 29G and acting as a stop against the outward pull of the spring 30.

Subassembly 19 having been described previously, need not be redescribed.

Pressure on the button or knob 31 actuates the subassembly 19, and simultaneously compresses spring 30. Upon release of the knob 31, the spring 30 relaxes and urges the knob and shaft outwardly.

It should be further understood that the motor, mount bracket and microswitch may be purchased as an over the counter subassembly from Universal Mfg. Co.

Thus as to operation, it is seen therefore that when the customer wants to observe the lighting associated with the lighting showroom display unit of this invention, that he or she pushes the button 31, the various lights come on for The predefined period, and then turns off without the customer having to take the steps to turn them off.

The invention of this application is suitable for 20 amp load capability, (while other prior art units are not) when the microswitch chosen for employment here bears a rating of 25 amps for resistive and inductive loads. Time delay relays as here to date employed in the prior art are only rated for 10 amp resistive and 7.5 amp inductive loads only. This is an important plus for this invention since the National Electrical Code, which pertains to commercial electrical installations, states that loads shall not exceed more than 80% of the rating of control devices.

Obviously it is within the scope of the invention to preset the time of an interval to any desired period ranging from 20 seconds to 2 minutes or more if desired. Though neither end of this scale is deemed critical. This can be accomplished by motor shaft rotation speed, or diameter of the circle of rotation of the timing cam. The mechanics to do so are well within the skill of the routineer.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. An energy saving lighting display unit for customers to inspect lighting fixtures being offered for sale, in a lighted condition for a finite time period, comprising:

a. a superstructure having a main body portion having a front wall, with a top front projection disposed at the top thereof, and a base portion at the bottom thereof to render the superstructure self supporting;

b. one or more lighting fixtures physically disposed on said superstructure and electrically connected to;

c. a multioutlet power strip mounted on said superstructure and which strip is electrically connected to;

d. a light control system mounted on the front wall of said body portion, said light control system having first and second power line cords, said first line cord being electrically connected to a source of AC power, while the second of said line cords provides the electrical connection to said power strip (c); said light control system comprising:

(1) a housing, having disposed therein, (2) a spring mounted push button shaft for actuating a microswitch disposed through said housing, adjacent, (3) a shaft actuatable microswitch having a cam engaging means thereon, (4) a microswitch controllable motor, having a motor shaft, (5) a timing cam means mounted on said motor shaft, engageable with said cam engaging means of said microswitch, for actuating said microswitch, said motor being electrically connected to said microswitch and said first line cord, and said microswitch being electrically connected to said first and second line cords, whereby upon actuation of the microswitch by a person pushing the push button shaft, current passes through the switch to the motor, which causes the timing cam to rotate on the motor shaft for a finite time until impact with the cam engaging means on said microswitch, during which finite time current passes to the power strip to which are connected the one or more lighting fixtures thereby lighting the fixtures for the finite period, and extinguishing the lighting fixtures when the timing cam engages the cam engaging means on said microswitch thus again actuating the microswitch to turn off the current to the power strip.

2. In the lighting display unit of claim 1, wherein the lighting fixtures include any and all of wall mounted, ceiling 12 mounted and chain mounted fixtures.

3. In the lighting display unit of claim 1 wherein the housing of the light control system comprises a NEMA 1R box which is disposed in the main body portion of the superstructure.

4. In the lighting display unit of claim 1 wherein the multioutlet power strip is mounted behind the main body portion of said superstructure.

5. In the lighting display unit of claim 1 wherein the timing cam is set for a period of between 20 seconds and 2 minutes.

6. In the lighting display unit of claim 1 wherein the microswitch is a normally open switch and the cam engaging means thereon is an upstanding prong disposed on a pivotally mounted actuator.

7. In the lighting display unit of claim 1 wherein the spring mounted push button shaft for actuating a micro-switch, disposed through said housing, includes a knob on the end of the shaft and the spring mount is a return coil spring disposed on said shaft rearwardly of said knob.

8. In the lighting display unit of claim 3 wherein the spring mounted push button shaft for actuating a micro-switch, disposed through said housing includes a knob on the end of the shaft.

* * * * *